US009656372B2

(12) United States Patent
Weiner et al.

(10) Patent No.: US 9,656,372 B2
(45) Date of Patent: May 23, 2017

(54) SHARPENER FOR THICK KNIVES

(71) Applicant: EDGECRAFT CORPORATION, Avondale, PA (US)

(72) Inventors: Samuel Weiner, Wilmington, DE (US); Bela Elek, Wilmington, DE (US); Daniel D. Friel, Jr., Kennett Square, PA (US)

(73) Assignee: EDGECRAFT CORPORATION, Avondale, PA (US)

( * ) Notice: Subject to any disclaimer, the term of this patent is extended or adjusted under 35 U.S.C. 154(b) by 0 days.

(21) Appl. No.: 14/992,240

(22) Filed: Jan. 11, 2016

(65) Prior Publication Data

US 2016/0207172 A1 Jul. 21, 2016

Related U.S. Application Data

(60) Provisional application No. 62/104,138, filed on Jan. 16, 2015.

(51) Int. Cl.
*B24B 3/54* (2006.01)
*B24D 15/08* (2006.01)

(52) U.S. Cl.
CPC ..... *B24D 15/08* (2013.01)

(58) Field of Classification Search
CPC ..... B24B 3/45; B24D 15/08; B24D 15/084
USPC ..... 451/45, 28, 293, 260, 349, 549, 229, 65
See application file for complete search history.

(56) References Cited

U.S. PATENT DOCUMENTS 2,137,201 A 11/1938 Boyer
2,841,926 A 7/1958 Lebus
2,860,452 A 11/1958 Lebus
D284,736 S 7/1986 Kawai et al.
4,627,194 A 12/1986 Friel
4,716,689 A 1/1988 Friel
4,807,399 A 2/1989 Friel
D303,209 S 9/1989 Friel
4,934,110 A 6/1990 Juranitch
D310,620 S 9/1990 Friel
5,005,319 A 4/1991 Friel
D328,410 S 8/1992 Friel
5,148,634 A 9/1992 Bigliano
5,245,791 A 9/1993 Bigliano
5,390,431 A 2/1995 Friel
5,611,726 A * 3/1997 Friel ..... B24B 3/54 451/177
5,620,359 A * 4/1997 Harrison ..... B24B 3/54 451/267
D409,891 S 5/1999 Friel
(Continued)

FOREIGN PATENT DOCUMENTS

EP 0629473 A2 12/1994

OTHER PUBLICATIONS

International Search Report for International Application PCT/US 16/13400, dated Apr. 22, 2016.

*Primary Examiner* — Robert Rose

(74) *Attorney, Agent, or Firm* — Drinker Biddle & Reath LLP

(57) ABSTRACT

A knife sharpener includes guide structure for accommodating thick blades of a knife. The guide structure includes a fixed guide surface having a convex portion to match a concave shape of the blade and a spring guide surface preferably has a convex portion to press against a hollow ground portion of the blade.

20 Claims, 6 Drawing Sheets

(56) References Cited

U.S. PATENT DOCUMENTS

| | | | |
|---|---|---|---|
| 6,012,971 | A | 1/2000 | Friel |
| 6,071,181 | A | 6/2000 | Wightman et al. |
| 6,113,476 | A | 9/2000 | Friel |
| 6,267,652 | B1 | 7/2001 | Friel |
| D491,783 | S | 6/2004 | Ikegaki et al. |
| 6,752,702 | B1 | 6/2004 | Thompson et al. |
| 6,802,763 | B1 | 10/2004 | Leung |
| 6,863,600 | B2 | 3/2005 | Friel |
| 6,875,093 | B2 | 4/2005 | Friel |
| 6,876,093 | B2 | 4/2005 | Goto et al. |
| 6,881,137 | B2 | 4/2005 | Friel |
| 6,932,683 | B2 | 8/2005 | Li |
| 6,997,795 | B2 | 2/2006 | Friel |
| D542,616 | S | 5/2007 | Elek |
| D543,430 | S | 5/2007 | Barr |
| 7,235,004 | B2 | 6/2007 | Friel |
| 7,287,445 | B2 | 10/2007 | Friel |
| D567,611 | S | 4/2008 | Elek |
| D575,124 | S | 8/2008 | Smith |
| 7,448,241 | B2 | 11/2008 | Davies |
| 7,452,262 | B2 | 11/2008 | Friel |
| 7,494,403 | B2 | 2/2009 | Friel |
| 7,517,275 | B2 | 4/2009 | Friel |
| D605,918 | S | 12/2009 | Deglon |
| 7,686,676 | B2 * | 3/2010 | Friel, Sr. ..... B24B 3/54 451/267 |
| D614,009 | S | 4/2010 | Deglon |
| D620,332 | S | 7/2010 | Elek |
| D632,153 | S | 2/2011 | Walker et al. |
| 8,043,143 | B2 | 10/2011 | Elek |
| D651,887 | S | 1/2012 | Elek |
| D652,284 | S | 1/2012 | Elek |
| D665,647 | S | 8/2012 | Friel |
| 8,267,750 | B2 | 9/2012 | Friel |
| D680,399 | S | 4/2013 | Elek et al. |
| D688,545 | S | 8/2013 | Jensen et al. |
| 8,585,462 | B2 | 11/2013 | Jensen et al. |
| D699,534 | S | 2/2014 | Elek et al. |
| 8,678,882 | B1 | 3/2014 | Huber et al. |
| D705,625 | S | 5/2014 | Huber et al. |
| 8,858,299 | B2 | 10/2014 | Boelter |
| 9,168,627 | B2 | 10/2015 | Elek et al. |
| 9,242,331 | B2 | 1/2016 | Elek et al. |
| 2003/0077990 | A1 | 4/2003 | Li |
| 2003/0236061 | A1 | 12/2003 | Li |
| 2004/0077296 | A1 | 4/2004 | Friel et al. |
| 2007/0077872 | A1 | 4/2007 | Elek et al. |
| 2008/0261494 | A1 | 10/2008 | Friel et al. |
| 2009/0209177 | A1 | 8/2009 | Walker |
| 2009/0233530 | A1 | 9/2009 | Friel |
| 2009/0298401 | A1 | 12/2009 | Smith et al. |
| 2013/0165021 | A1 | 6/2013 | Jensen et al. |
| 2014/0198198 | A1 | 7/2014 | Geissbuehler et al. |

* cited by examiner

SHARPENER FOR THICK KNIVES

CROSS REFERENCE TO RELATED APPLICATION

This application is based on provisional application Ser. No. 62/104,138, filed Jan. 16, 2015, all of the details of which are incorporated herein by reference thereto.

BACKGROUND OF THIS INVENTION

Historically, the geometry of knife blades has varied significantly in length, thickness and shape of the blade. This has been particularly the case for sport, pocket knife and tactical knife blades.

In order to control the sharpening angle, the face of the knife blade is laid on a planar surface, acting as the angle guide, and held by hand, a magnet or a spring against that surface.

Because of the geometric complexity and variety of thickness of the sports and tactical knife blades, the positioning of these type of blades on such planar angle guides is unstable and ambiguous. Consequently, the precise angular control of the edge facets to be sharpened are further compromised when the knife blades are excessively thick and the blade is held in place against the guide by a spring which creates increasing friction as the blade is pulled through the sharpening slot.

SUMMARY OF THE INVENTION

An object of this invention is to provide a sharpener capable of precision sharpening a larger variety of knives, and in particular be more effective in sharpening and angle control the thicker sport, pocket knife and tactical knife that contain a partially hollow ground concave blade.

Recently, these inventors have discovered a combination of a unique spring and knife angle guide design that can effectively hold the above knives precisely and reproducibly in position during the sharpening process.

The success of this design centers on "mimicking", in reverse, the typical profiles of the type of knife blades on the knife angle guide and preferably the spring that holds the knife against the angle guide.

THE DRAWINGS

DETAILED DESCRIPTION

Prior art on combinations of knife angle guides and springs are described in U.S. Pat. No. 5,611,726 ('726 patent) and U.S. Pat. No. 7,686,676 ('676 patent), all of the details of which are incorporated herein by reference thereto. In both of these patents, the knife angle guides, against which the knife blade rested were planar. These type of planar angle guides are particularly effective when the surface of the knife blade is itself planar and the contact surface of the guide matches that of the knife blade. However, many of the sport, pocket knife and tactical knife blades are not planar. Many of these knives have hollow ground blades as shown in FIGS. 2-3.

Figure 2:
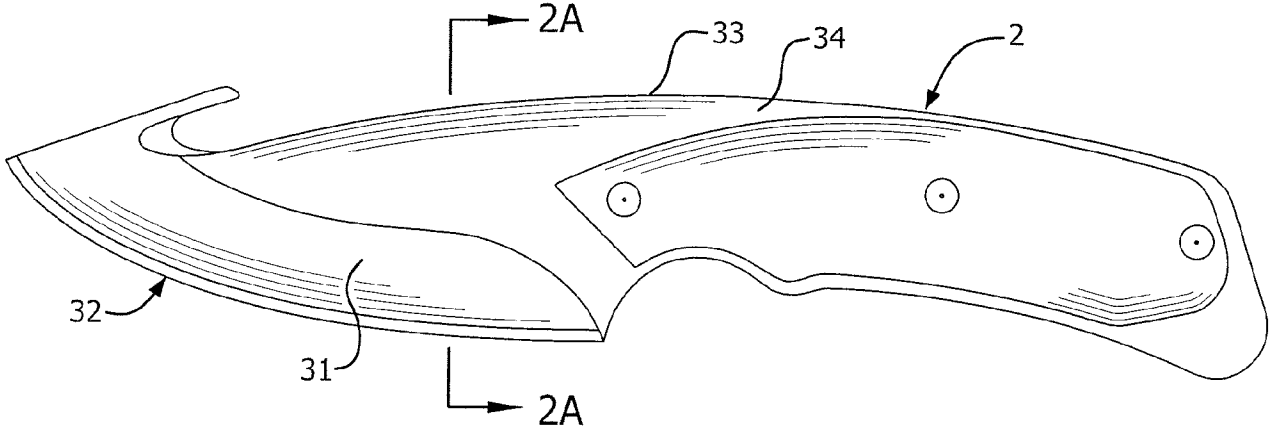
FIGS. 2-3 are side elevational views of typical hunting knives which may be sharpened by the sharpener of FIG. 1.
Figure 3:
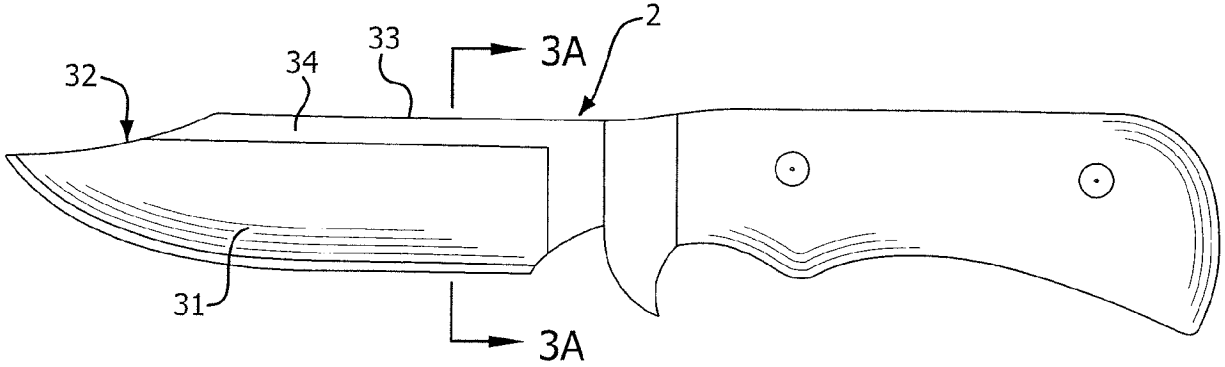

While the conventional shaped knife holding spring works well with a flat faced blade, the typical hunting knives 2, having blade 32, shown in FIGS. 2 and 3, become surprisingly unstable. Commonly the large portions 31 of the face of hunting knives is hollow ground. The hunting knives are constructed this way to reduce the thickness of blade 32 behind the edge so that less metal need be removed to sharpen them and making them easier to sharpen. The back 33 of the blade 32 and the adjacent areas 34 along the blade edge can by this design be very thick, on the order of ⅛ to 3⁄16" thick, creating a very strong knife for heavy duty work.

Figure 2A:
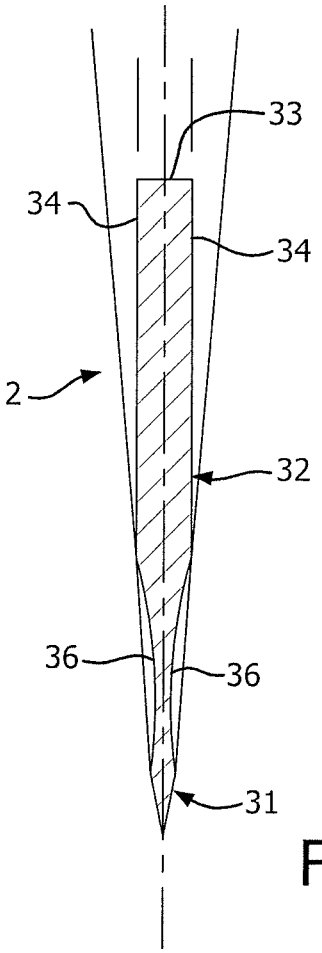
FIGS. 2A and 3A are cross-sectional views of the hunting knives shown in FIGS. 2-3 taken along the lines 2A-2A and 3A-3A, respectively.
Figure 3A:
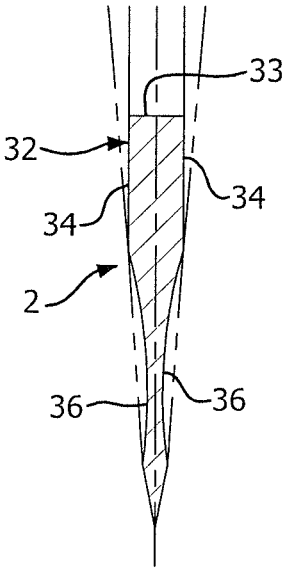

The cross section A-A of these blades is shown in adjacent FIGS. 2A and 3A. These commonly show hollow ground concave features 36 on the lower sections 31 of the blade 32 face adjacent to the edge, but the upper section 34 of the blade 32 faces adjacent to the blade backs 33 are generally planar and parallel to each other.

Although the '676 patent addressed this inconsistency by focusing the spring guide force against the hollow ground (concave) portion of the knife blade, it only partially addressed the ambiguity of the blade's positioning on the planar knife guide. By applying the pressure in the hollow ground portion of the knife blade, it forced the opposite side of the knife blade to assume a position against the planar knife guide following a tangent line spanning the apex of the blade edge to the shoulder of the hollow ground geometry where it transitions to the flat portion of the blade. Although this improvement covered by the '676 patent, improved the guiding of knife blades over the '726 patent, the inventors noted that instability still existed in alignment of sports and tactical knives, particularly thicker ones with hollow ground blades, where the friction between knife guide and the spring increases, requiring greater force to pull the knife through. However, the guide system described in the '676 patent allowed for significant tilting of the knife blade thereby diminishing the precision of the edge formation.

Figure 1:
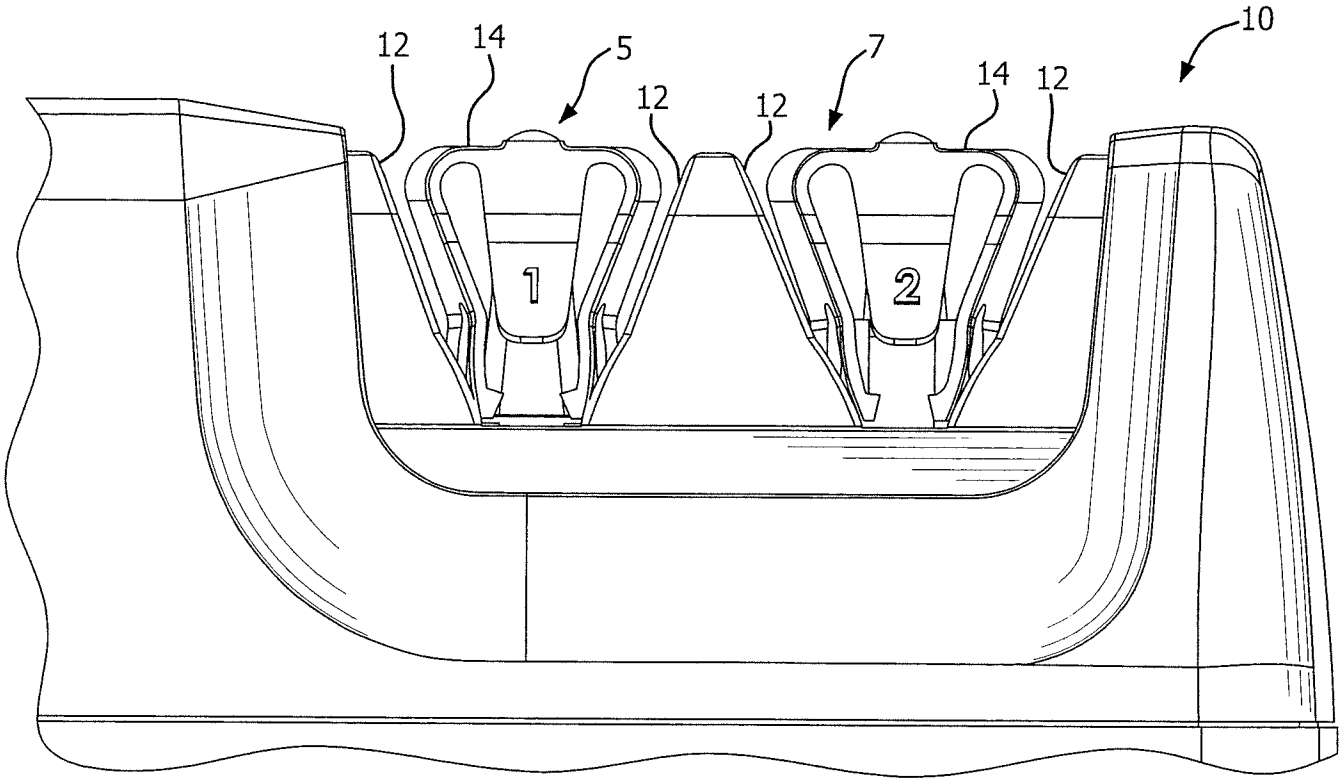
FIG. 1 is a side elevational view of a portion of a sharpener for thick knives showing two sharpening stages in accordance with this invention.
Figure 4:
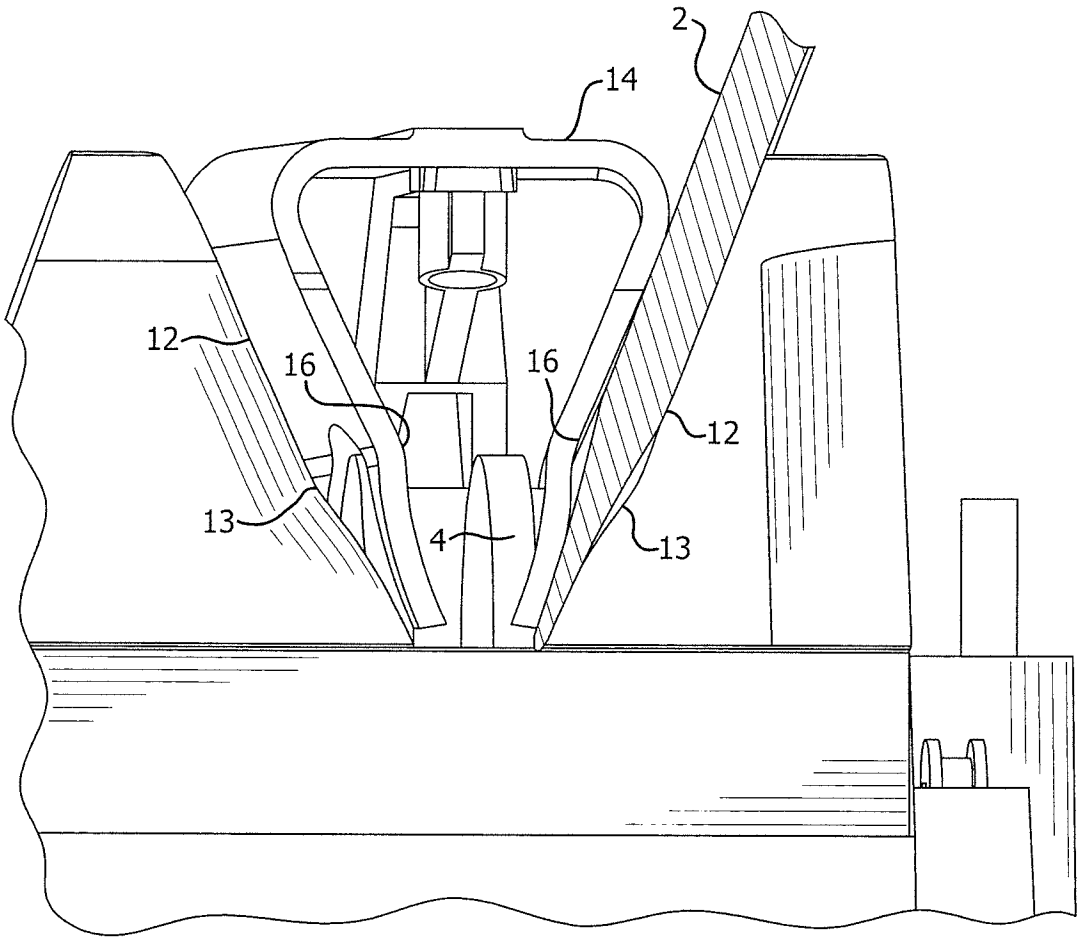
FIG. 4 is a cross-sectional view of one of the stages of the knife sharpener shown in FIG. 1 showing a knife being sharpened.

FIG. 1 illustrates a sharpener 10 in accordance with this invention. As shown therein sharpener 10 includes at least one pre-sharpening stage 5 and a finishing stage 7. Each stage includes a pair of fixed guides 12 and a spring 14. FIG. 4 shows one of the stages, namely the finishing stage, in its condition of use. The same operation would apply to all stages for each guiding slot in each stage.

FIG. 4 illustrates a cross section of a thick hunting knife 2 with a hollow ground blade inserted into the guided sharpening slot of knife sharpener 10 against a sharpening member 4 using this invention. The sharpening members 4 preferably are rotatable disks having an abrasive surface. The sharpening members could also have a non-abrasive steeling surface. The hollow ground portion of the blade rests against the non-planar knife guide 12 which provides a convex portion 13 to match the concave shape of the hollow ground blade. On the other side of the knife blade, the spring guide 14 with a convex portion 16 presses against the hollow ground portion of the blade. The result is that the hollow ground portion of the blade is nested between matching formed convex guides. This allows for a predictable alignment of the center line of the blade's cross section and the surface of the sharpening member for a precise determination of the half angle of the knife's edge.

As shown in FIG. 4 the non-planar knife guide 12 may be considered as having an upper segment at the upper end of the sharpening slot. The upper segment merges into an intermediate segment which then merges with a lower segment. The intermediate segment extends from the upper segment in a direction away from the spring guide surface to merge with the lower segment. The lower segment is at the lower end of the sharpening slot. Similarly, the convex or non-planar portions 16 of spring guide 14 may be considered as comprising an upper surface which merges into an intermediate surface which then merges into a lower surface. The upper surface is at the upper end of the sharpening slot opposite the upper segment of the knife guide 12. The intermediate surface is opposite the intermediate segment of the knife guide 12. At least a part of the intermediate surface extends in a direction toward the intermediate segment. The lower surface is at the lower end of the slot opposite the lower segment.

An additional benefit of this guide structure is that the spine, or thicker portion, of the knife blade is in reduced contact with either the upper portion of the guide surface or the spring guide, thereby reducing the friction when sharpening thick knives. With thinner knives, contact with the upper portions of the guide surface or spring guide may be totally eliminated, thereby further reducing friction during sharpening.

In order to increase the versatility of sharpeners with the novel knife holding spring 14 and knife guide 12 design as described above, these inventors discovered that by controlling the relative stiffness of the lower and upper portions of the spring arms it is possible to stabilize the larger sporting and tactical blades as described but also to stabilize smaller pocket knives and kitchen paring knives.

Surprisingly, the inventors also discovered that by combining part of this invention, namely the non-planar knife guide 12 of this invention with the spring guide described in the '676 patent, an effective and stable positioning of the knife edge relative to the abrasive surface was achieved. This was possible because the focus of the spring guide force, as described in the '676 patent, is against the lower portion of the hollow ground knife blade. Furthermore, this combination of non-planar knife guide of this invention with the spring guide of '676 patent also effectively sharpens knives with narrower blades such as paring knives, fish filet knives and pocket knives.

Figure 5:
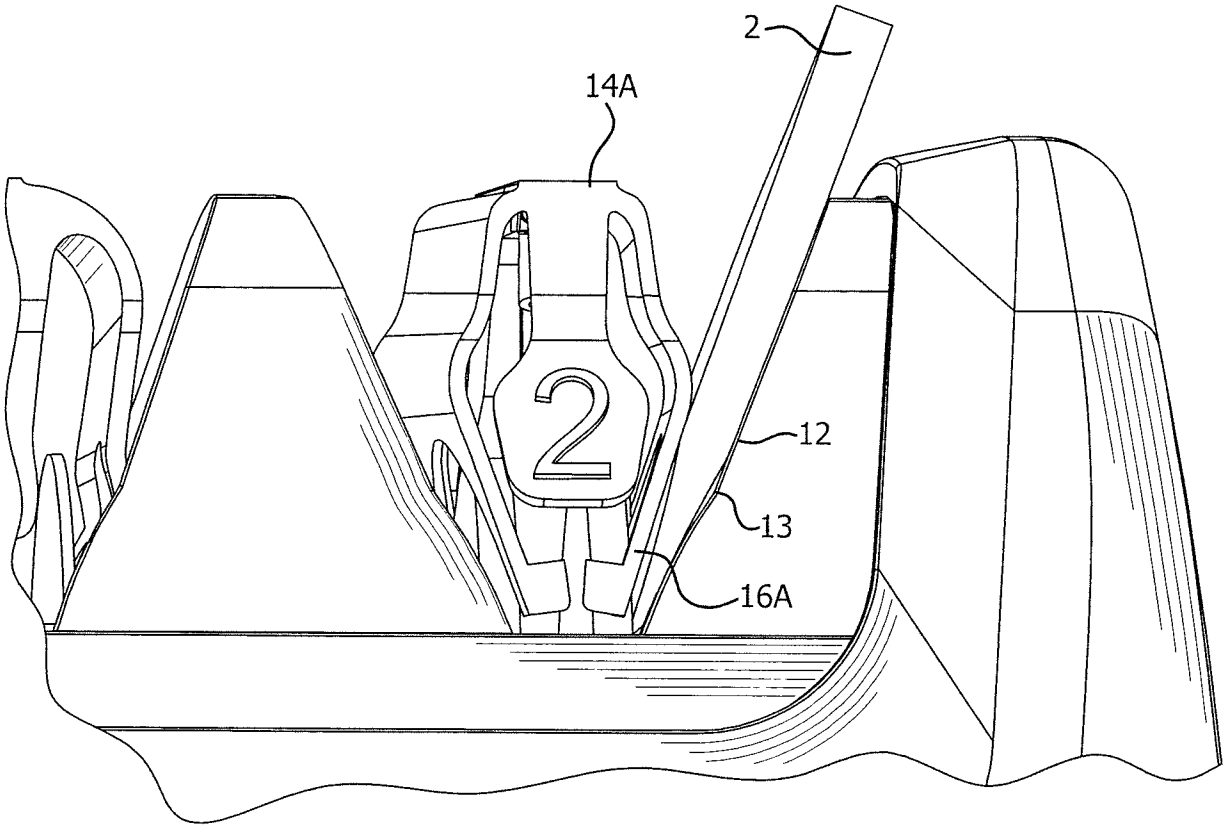
FIG. 5 is a view similar to FIG. 4 showing an alternative spring guide.

FIG. 5 illustrates the combination of the non-planar knife guide 12 having its convex portion 13 used with a spring guide 14A having a planar spring end 16A rather than the convex portion 16 shown in FIG. 4.

Figure 6:
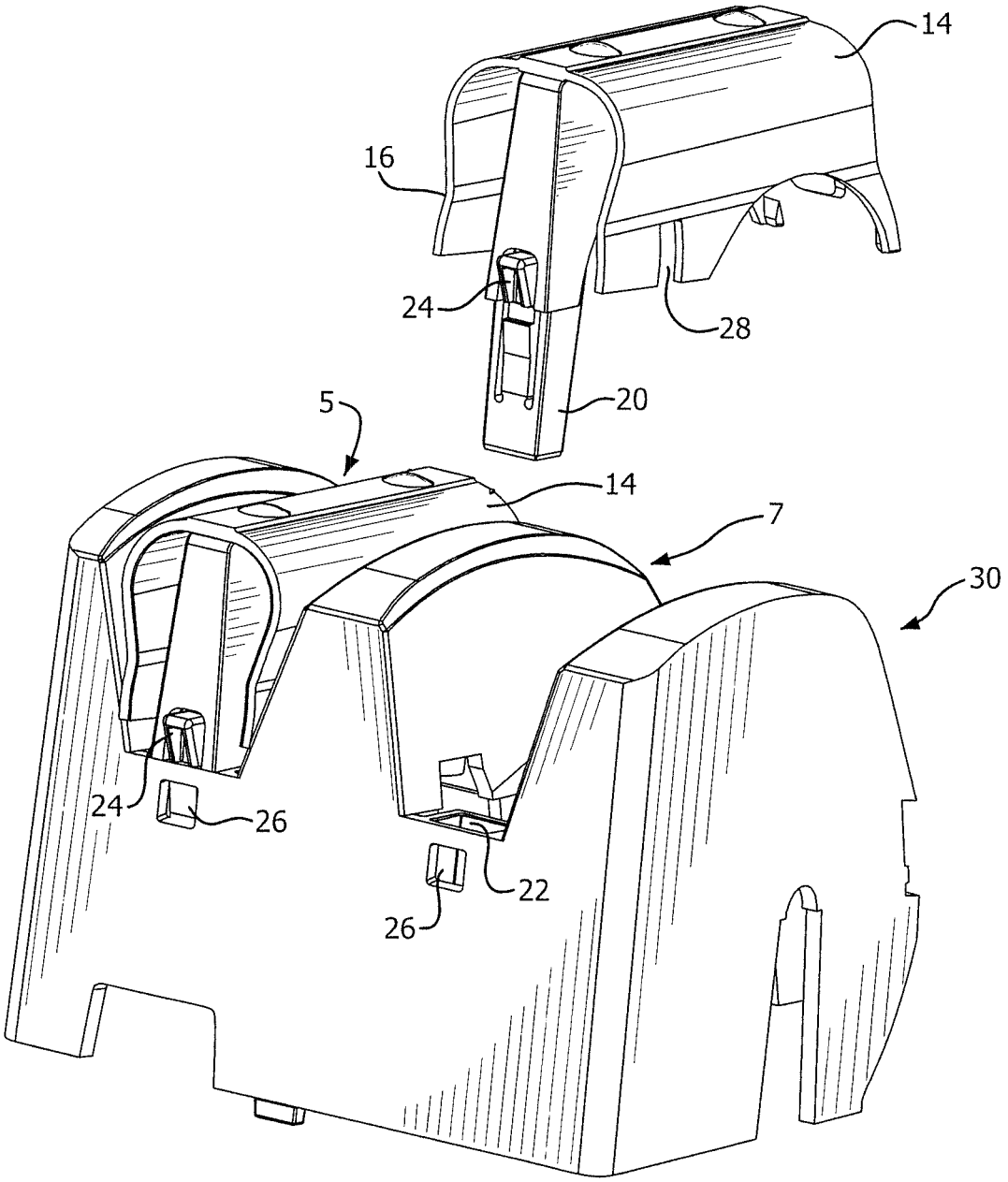
FIG. 6 is an exploded view of a variation of the removable or interchangeable knife guides which may be used in accordance with this invention.

FIG. 6 is an exploded view showing two of the stages of a sharpener which may incorporate a removable spring 14 to add to the versatility of the sharpener for accommodating different specific thick knife structures. Except for the later noted differences, spring 14 is similar to the spring in U.S. published application 2015/0258651 ('651 application), all of the details of which are incorporated herein by reference thereto. The primary difference is that spring 14 of FIG. 6 has a non-planar spring arm, whereas the corresponding spring arm in the '651 application is planar. The spring of the '651 application could be usable in the embodiment of FIG. 5.

As illustrated FIG. 6 the spring 14 includes a post 20 which of a size and shape to be inserted into a channel 22 in the fixed portion of the sharpener. Post 20 includes a deflectable spring 24 which would then snap into opening 26 in the sharpener to mount the spring in place. The left-hand portion of FIG. 6 shows a spring 14 partially inserted while the right-hand portion shows a spring completely detached. The ability to use replicable springs provides the sharpener with various spring guide structures to accommodate different knives. If desired, the fixed guiding surface might also have a detachable sheet-like guide surface that could be mounted against the permanent guide surface corresponding to fixed guide surface 12, thus providing the ability to replace the fixed guide surface with different guide shapes.

As shown in FIG. 6 one of the spring arms of spring 14 includes the non-planar portion 16. Unlike the spring of the '651 application, the opposite spring arm of spring 14 is split, having a gap or open area 28 between the spring arm portions.

FIG. 6 illustrates a module 30 that could be detachably mounted in the sharpener housing. The module 30 is illustrated as including the finishing stage 7 and a pre-sharpening stage 5. The module 30 could be mounted in the housing as described in the '651 application.

Although the prior description has been directed to sharpeners using abrasive coated sharpening members it is to be understood that the invention can also be practiced where the member is a steeling or conditioning member substantially free of abrasive particles. Reference is made to U.S. Pat. Nos. 7,235,004 and 7,287,445, all of the details of which are incorporated herein by reference thereto. Thus, the invention can be incorporated into sharpeners which have sharpening members which use abrasives, which steel the edge or which condition the edge. The knife holding springs will be effective regardless of what is being done to the edge facets. Accordingly, unless otherwise specified the term "knife sharpener" and the term "sharpening member" are intended to include abrasive sharpening as well as steeling or conditioning.

While the need for this improved design has been described as it is used in electric or powered sharpeners that commonly have a force applying spring urging an abrasive covered disk toward the knife edge as it is being sharpened, this novel spring design is applicable also to manual sharpeners with stationary abrading or steeling surfaces.

The guide technology of this invention can be used for sharpening metal knives or ceramic knives, even knives that do not have hollow ground blades.

What is claimed is:

1. In a knife sharpener having at least one sharpening stage with guide structure in the stage, the guide structure comprising a fixed guide surface and a spring having a guide surface forming a slot, the slot having an upper end and a lower end to guide a knife blade against a sharpening member, the improvement being in that the fixed guide surface has a non-planar portion for being disposed at a hollow ground portion of a thick blade, the non-planar portion being formed by the fixed guide surface having an upper segment at the upper end of the slot, the upper segment merging into an intermediate segment which merges into a lower segment, the intermediate segment extending from the upper segment in a direction away from the spring guide surface and then in a direction toward the spring guide surface to merge with the lower segment, the lower segment being at the lower end of the slot near the sharpening member, and the spring guide surface having a portion to press against a hollow ground portion of the opposite side of the blade.

2. The sharpener of claim 1 wherein the sharpener is a multi-stage sharpener and the guide surface being provided in each of the stages.

3. The sharpener of claim 1 wherein the sharpening member comprises rotatable disks having an abrasive surface.

4. The sharpener of claim 1 wherein the sharpening member has a non-abrasive steeling surface.

5. The sharpener of claim 1 wherein the sharpener is a manual sharpener.

6. The sharpener of claim 1 wherein the sharpener is an electric sharpener.

7. The sharpener of claim 1 wherein the portion of the spring guide surface is non-planar.

8. The sharpener of claim 7 wherein the non-planar portion of the spring guide surface comprises an upper surface which merges into an intermediate surface which merges into a lower surface, the upper surface being at the upper end of the slot opposite the upper segment, the intermediate surface being opposite the intermediate segment, at least a part of the intermediate surface extending in a direction toward the intermediate segment, and the lower surface being at the lower end of the slot opposite the lower segment.

9. The sharpener of claim 1 wherein the portion of the spring guide surface is planar.

10. The sharpener of claim 1 wherein the sharpener includes a housing, and the spring being removably mounted in the housing.

11. The sharpener of claim 10 wherein the spring guide surface is non-planar.

12. The sharpener of claim 1 wherein the sharpener includes a housing, a module removably mounted to the housing, the fixed guide surface being in the module, and the spring being in the module.

13. The sharpener of claim 12 wherein the spring is detachably mounted to the module.

14. A method of sharpening a knife having a blade comprising providing the sharpener of claim 1, inserting the blade into the slot created by the fixed guide surface and the spring guide surface, pressing the spring guide surface against the blade, and sharpening the blade by disposing the blade against the sharpening member.

15. The method of claim 14 wherein the knife is a knife which has a hollow ground portion, and disposing the intermediate segment of the fixed guide surface to match the shape of the blade.

16. The method of claim 15 including providing the sharpener of claim 8, and disposing the intermediate surface of the spring guide against the blade.

17. The method of claim 15 including providing a spring guide surface which is planar.

18. The method of claim 15 including aligning the center line of the blade's cross-section and the surface of the sharpening member for a precise determination of the half angle of the blade's edge.

19. The method of claim 15 including reducing contact of the spine of the knife blade with at least one of the upper portion of the fixed guide surface and of the spring guide surface to reduce friction while the blade is being sharpened.

20. The sharpener of claim 8 wherein the distance between the intermediate segment of the fixed guide surface and the intermediate surface of the spring guide surface is the maximum distance between the fixed guide surface and the spring guide surface in the slot.

* * * * *